US005603467A

United States Patent [19]

Perini et al.

[11] Patent Number: 5,603,467

[45] Date of Patent: Feb. 18, 1997

[54] REWINDER FOR PRODUCING LOGS OF WEB MATERIAL, SELECTIVELY WITH OR WITHOUT A WINDING CORE

[75] Inventors: Eva Perini, S. Michele a Moriano; Guglielmo Biagiotti, Capannori, both of Italy

[73] Assignee: Fabio Perini S.p.A., Lucca, Italy

[21] Appl. No.: 598,466

[22] Filed: Feb. 8, 1996

Related U.S. Application Data

[63] Continuation of Ser. No. 381,857, filed as PCT/IT94/00075, Jun. 1, 1994, abandoned.

[30] Foreign Application Priority Data

Jun. 9, 1993 [IT] Italy ..... FI93A0109

[51] Int. Cl.[6] ..... B65H 18/20; B65H 19/30

[52] U.S. Cl. ..... 242/521; 242/541.2; 242/542.2; 242/533.2

[58] Field of Search ..... 242/521, 533, 242/533.1, 533.2, 533.3, 535.1, 542, 542.1, 542.2, DIG. 3

[56] References Cited

U.S. PATENT DOCUMENTS

| | | | |
|---|---|---|---|
| 3,250,484 | 5/1966 | Fair . | |
| 3,850,381 | 11/1974 | Moore | 242/541.2 |
| 4,487,377 | 12/1984 | Perini | 242/521 |
| 5,137,225 | 8/1992 | Biagiotti . | |

FOREIGN PATENT DOCUMENTS

| | | |
|---|---|---|
| 0498039A1 | 8/1992 | European Pat. Off. . |
| 0580561A2 | 1/1994 | European Pat. Off. . |

*Primary Examiner*—John M. Jillions
*Attorney, Agent, or Firm*—Francis J. Bouda

[57] ABSTRACT

A surface automatic rewinder for winding web material (N) in logs or rolls (R) is described, including a first winder roller (1), a second winder roller (3) which defines, with the first winder roller, a nip (5) through which the web material is fed, core feeder (19, 21) to feed the cores (A) on which the web material is wound for the formation of rolls or logs, and an inserter (27) for inserting the cores into the nip (5). The rewinder is characterized in that the inserter (27) may be moved to an inoperative position whereupon the winding of the web material can be accomplished without a winding core.

16 Claims, 5 Drawing Sheets

REWINDER FOR PRODUCING LOGS OF WEB MATERIAL, SELECTIVELY WITH OR WITHOUT A WINDING CORE

This application is a CONTINUATION of application Ser. No. 08/381,857, filed as PCT/IT94/00075, Jun. 1, 1994 now abandoned.

TECHNICAL FIELD

The invention refers to a surface automatic rewinder for winding a web material onto a core to form logs or rolls. It includes a first winder roller, a second winder roller which defines, with the first winder roller, a nip through which the web material is fed; feeding means for feeding the cores on which the web material is wound for the formation of rolls or logs; an insertion means for inserting the cores into said nip.

BACKGROUND ART

Rewinders of this type are known, for example, from U.S. Pat. No. 4,487,377 and U.S. Pat. No. 5,137,225, or from the British Patent GB 2,105,688. Such rewinders are commonly used in the paper converting industry to produce, starting from parent rolls of large diameter, a plurality of rolls or logs of smaller diameter which are subsequently cut to form small rolls of toilet paper, all-purpose wipers, industrial rolls or the like.

Attempts have also been made to provide rewinders for producing rolls or logs without a core. For example, U.S. Pat. No. 4,487,378 shows a system for producing logs of wound web material in which the winding takes place on a mandrel which is subsequently withdrawn from the completed log. These winding systems are unsuitable to meet the current requirements of high productivity in this field.

One object of the present invention is to provide a surface automatic rewinding machine able to produce, at a high rate, rolls or logs of web material with or without winding core. A further object of the present invention is to provide a rewinding machine which is able to shift, in an extremely fast and simple way, and with no need for special adjustments, from the production of core logs to the production of coreless logs, and vice versa.

DISCLOSURE OF THE INVENTION

These and further objects and advantages, which will appear evident to those skilled in the art from a reading of the following description, are achieved by a rewinder of the above mentioned type, characterized in that the core insertion means may be moved to an out-of-service position, and means are provided to start the winding of the log of web material without a winding core. Said winding means are operable relatively with or without the core feeding and insertion means.

With the above and other objects in view, further information and a better understanding of the present invention may be achieved by referring to the following detailed description:

BRIEF DESCRIPTION OF DRAWINGS

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts.

BEST MODE FOR CARRYING OUT THE INVENTION

Figure 1:
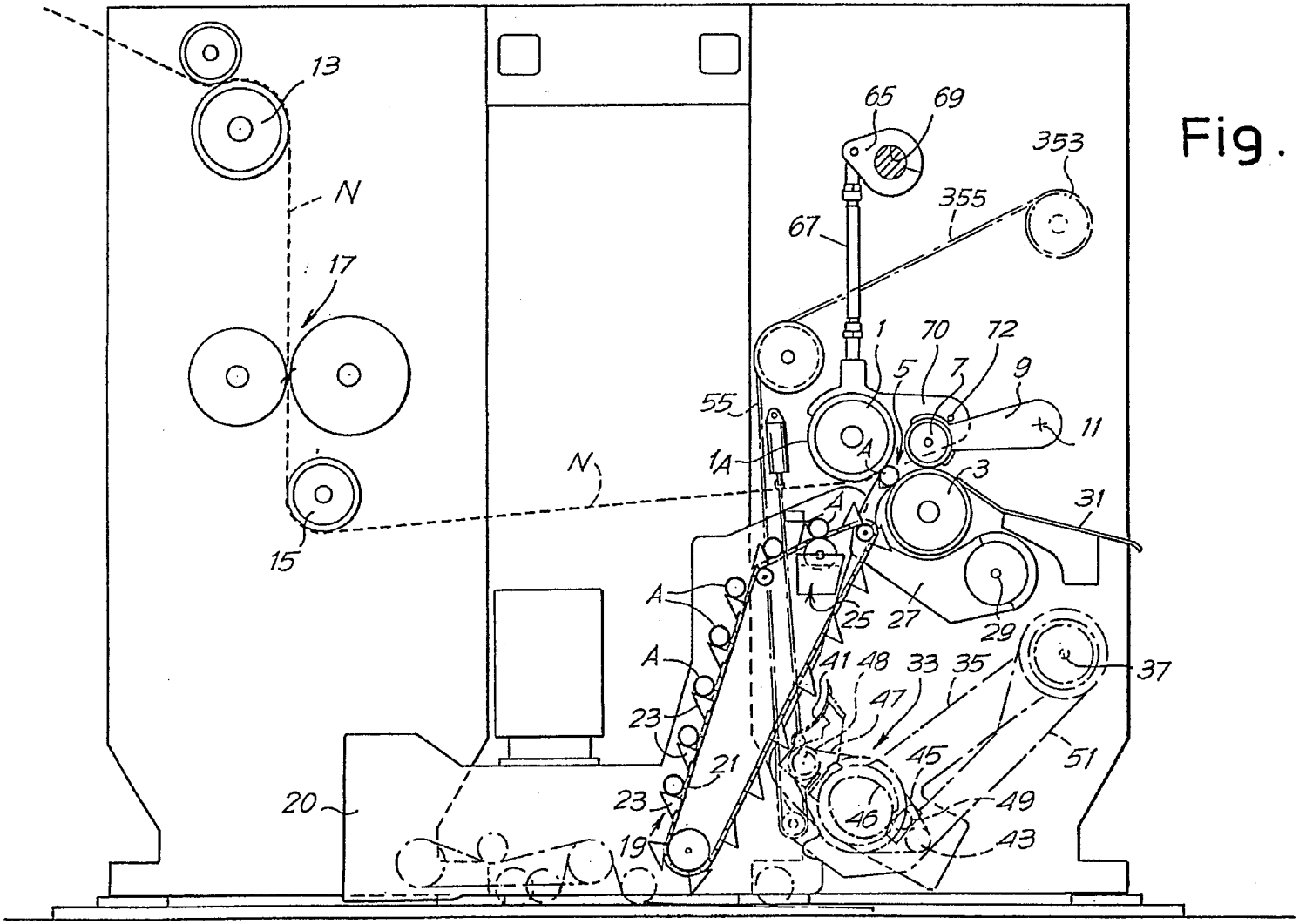
FIG. 1 diagrammatically shows a first embodiment of a rewinder, according to the invention, in operating condition for the production of logs provided with winding cores.

As far as the production of logs provided with cores is concerned, the rewinder of FIG. 1 has a construction similarly disclosed in co-pending U.S. patent application Ser. No. 07/911,005, filed on Jul. 9, 1992, now U.S. Pat. No. 5,368,252 and EP-A-0 524 158, the content of which is incorporated by reference in the present invention.

Referring first only to the members necessary for the production of logs provided with winding core, the rewinder of FIG. 1 includes a first winder roller 1 and a second winder roller 3 which define a nip 5 through which the web material N to be wound is fed. Indicated by 1A is the cylindrical surface of the roller 1. The nip 5 has, in this condition, a cross dimension equal to or slightly smaller than the diameter of the cores A on which the web material is wound. A third winder roller 7, supported by an oscillating arm 9 pivoted at 11 to the machine frame, defines a winding space for the formation of logs. The roller 7 moves gradually upwards about the axis 11 to allow and control the increase of the diameter of the log in the course of formation. The web material N is unreeled from a feeding roll (not shown) and guided towards the winding region by a series of driving and guiding rollers 13, 15. Before reaching the winding region defined by the rollers 1, 3 and 7, the web material N goes through a perforator unit 17, wherein it is perforated along transverse lines.

Numeral 19 generally indicates a means for feeding the cores A on which the web material N is wound for the production of logs. The means 19 includes an endless conveyor 21 provided with a series of supports 23 on which the cores A are placed, which are picked up one by one from a hopper container or the like (not shown). Each core A passes a gluing unit 25 which applies a thin layer of glue thereon to allow the leading edge of the web material to be anchored thereto. The individual cores fed by the conveyor 21 are picked up by an insertion means 27 pivoted at 29 to the machine frame and provided with an oscillating intermittent motion which is synchronized with the machine speed. Upon completion of a log, the insertion means 27 inserts a new core A into the nip 5 between rollers 1 and 3. The tearing of the web material, the unloading of the completed log onto a surface 31, and the start of the winding of a new log take place according to known procedures.

The elements so far described allow the production of logs provided with a winding core. However, the machine is also arranged for producing rolls or logs of web material N without a winding core. To this end, in this exemplary embodiment, provision is made for a unit 33 carried by an oscillating arm 35 and pivoted at 37 to the machine frame. In FIG. 1, the unit 33 is shown in dotted lines in the position it takes up when not in use. When it is desired to produce logs without a central core A, the machine members are moved from the position of FIG. 1 to that of FIG. 2.

Figure 2:
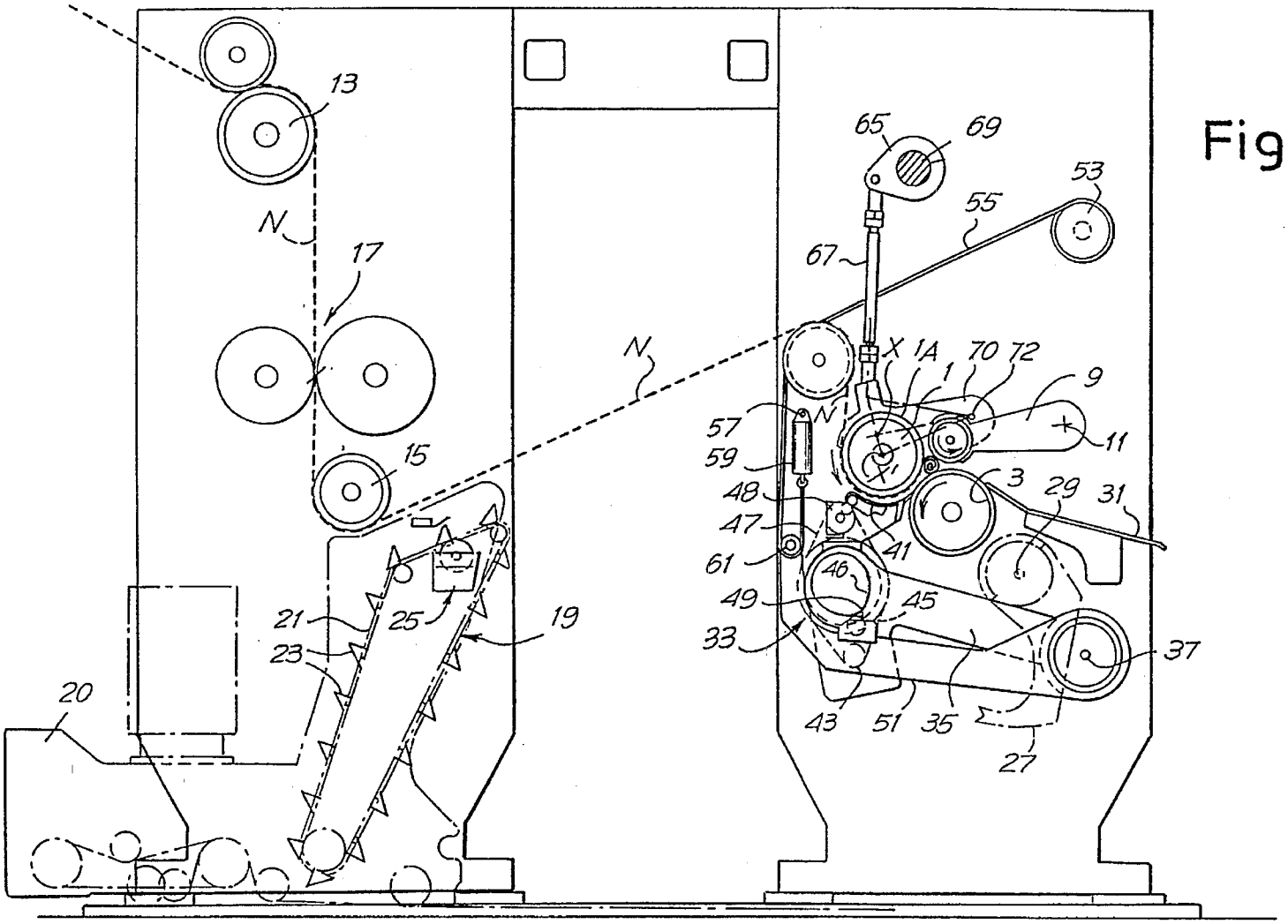
FIG. 2 shows the rewinder of FIG. 1 in a condition predisposed for the production of logs without winding cores.

As can be seen in FIG. 2, the core feeding means 19 has been shifted to the left and moved away from the winding region. This is accomplished by placing said core-feeding means on a motor-driven carriage 20.

The unit 33 has been moved in a clockwise rotation from the withdrawn position of FIG. 1 to a position in which it cooperates with the winding rollers 1 and 3, which have been brought closer to one another. At the same time, the insertion means 27 moves, in counterclockwise direction about the axis 29, from the active position of FIG. 1 to a lower withdrawn position (shown with dotted lines in FIG. 2).

The unit 33 is the subject of U.S. patent application Ser. No. 090,519 filed Jul. 13, 1993, the content of which is incorporated by reference in the present description. Therefore, the construction of the unit 33 will be described herein only generally. The said unit includes a curved surface 41 which, when the unit is at the position of FIG. 2, defines a channel, along with the surface of roller 1, in which the web material N begins to wind up on itself in the absence of a winding core. A motor 43 or other suitable actuator, mounted on arm 35, through a first flexible member 45, a cam 46, a second flexible member 47 and an eccentric system 48, causes an intermittent movement bringing the surface 41 close to the cylindrical surface of roller 1.

In practice, in the condition shown in FIG. 2, the motor 43 is driven into rotation shortly before the end of the winding of a log. This will cause the unit 33 (and thus of surface 41) to move towards the roller 1 as a result of the cooperation of cam 46 with a tappet 49 carried by an arm 51. The same movement of the motor 43 will also cause a movement of the surface 41 towards the roller 1 through the action of the eccentric system 48. The sum of the two oscillation motions brings the surface 41 into contact with the surface of roller 1 only once upon every revolution of cam 46. This causes the web material N to tear and the free leading edge thus formed to curl on itself, to create a new log. The first turns thus formed grow rapidly in diameter and roll along the surface 41 to reach the nip 5 and pass therethrough into the winding space defined by the rollers 1, 3 and 7. The passing of the log in the course of formation through the nip 5 is accomplished by the (temporary or constant) difference in speed between the rollers 1 and 3. The procedures for tearing the web material N and for beginning the winding of the free edge on itself are illustrated in greater detail in the above-mentioned application Ser. No. 08/090,519 filed Jul. 13, 1993 (corresponding to EP Appl.N. 93830312.0, filed Jul. 20, 1993). The unit 33 may be made according to any of the embodiments described in the above-mentioned patent applications.

In order to shift the unit 33 carried by arm 35 to the active position of FIG. 2, a lifting system is provided including a rotating actuator, schematically shown at 53, and a flexible member 55 anchored by one end thereof to the actuator 53, by the opposite end to a fixed point 57 of the machine, and by the interposition of resilient dampening means 59. The flexible member 55 is driven around a small roller 61 carried by arm 51. The lifting of arm 51, due to the winding of flexible member 55 over actuator 53, causes also the lifting of arm 35 and thus of unit 33, owing to the cooperation between the eccentric 46 and the tappet 49. In actual practice, provision will be made, for two arms 35 and two arms 51, one on either side of the machine, with corresponding means 53, 55 for the lifting of the unit 33. In the operating position, the arms 51 are kept by the flexible element 55 against adjustable abutments (not shown in the figure) which are disposed one on each side of the frame and are independent of one another.

Because the formation of logs without winding cores produces a log as it enters the nip 5, with a much smaller diameter than that of the winding cores A, the rewinder according to the invention is provided with a system allowing the winding rollers 1 and 3 to move close to each other, in order to change the width of the nip 5 according to the type of product being made.

In the embodiment of FIGS. 1 and 2, provision is made for a crank-connecting rod system 65, 67 driven by a shaft 69. Said system moves roller 1 close to roller 3 when the rewinder is to form coreless logs, and thus the axis of roller 1 is displaced from position X to position X' (see FIG. 2). The displacement is obtained by moving an arm 70 supporting roller 1, about a pivot 72. It will be appreciated that provision may also be made for a motion causing the roller 3 to move close to roller 1. Moreover, as can be seen by a comparison of FIGS. 1 and 2, when shifting from the production of core logs to that of coreless logs, the path of the web material is changed as well. The same mechanism 65, 67, 69 which moves the roller 1 from position X to the position X', may be used (if controlled by a suitable servomotor) during the machine operation to move the roller 1 during passing of the just-started log between rollers 1 and 3. This in order to keep at a minimum the squeezing of said log.

Figure 3:
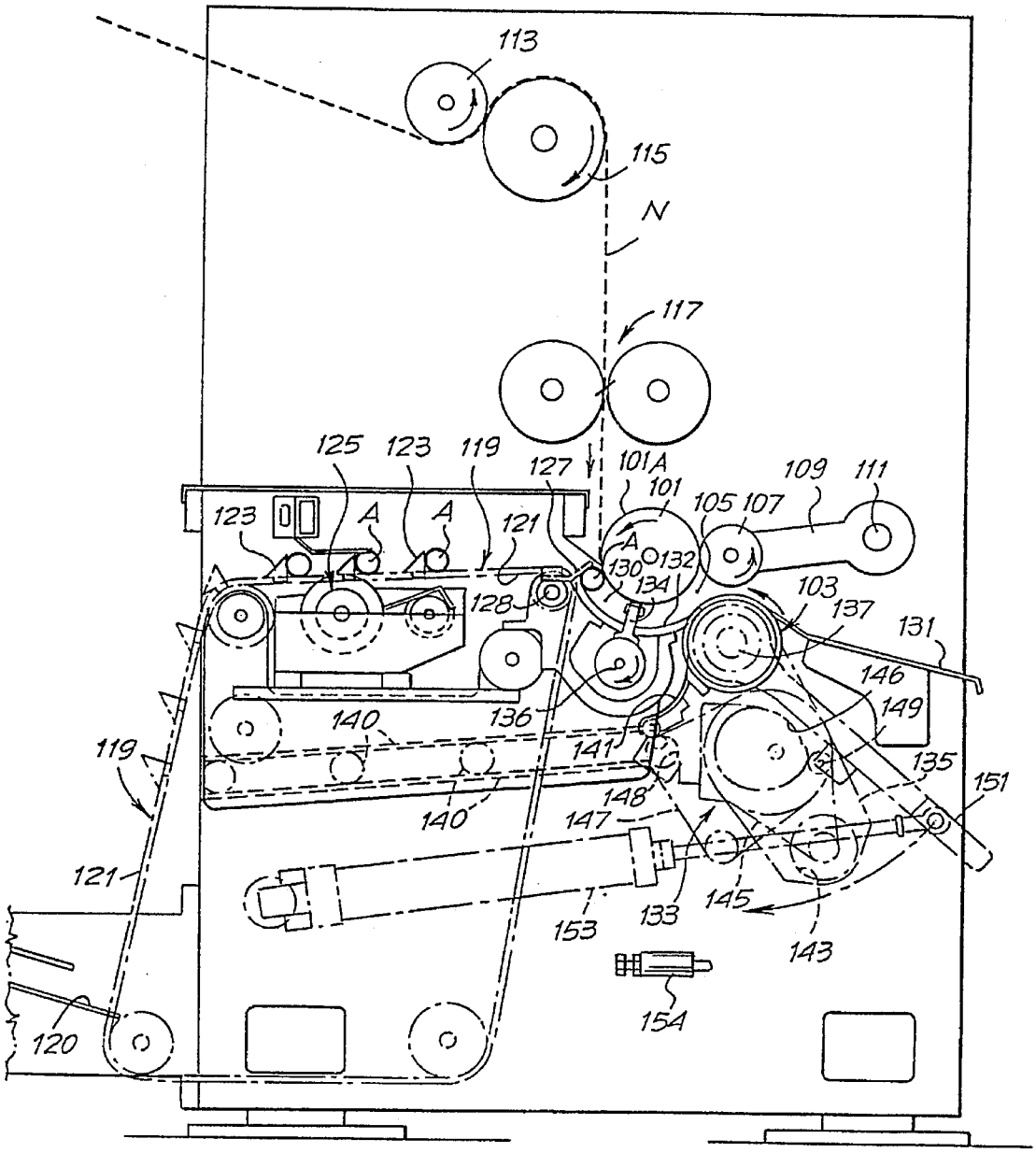
FIG. 3 diagrammatically shows a second embodiment of a rewinder according to the invention, in the operating condition for the production of logs provided with winding cores.
Figure 4:
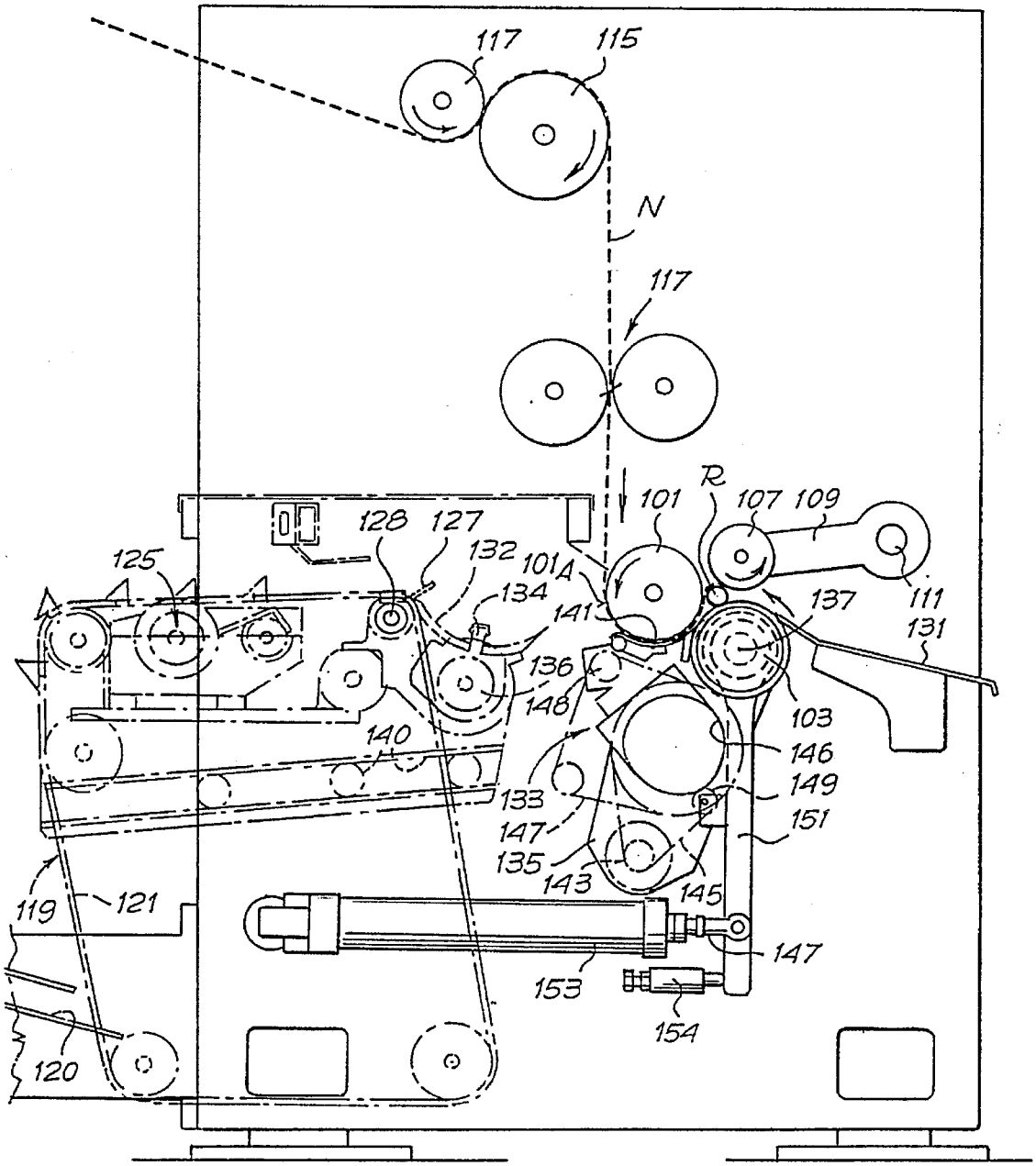
FIG. 4 shows the rewinder of FIG. 3 in the condition for the production of logs without cores.

FIGS. 3 and 4 show a different embodiment of the rewinder according to the invention. In the description which follows, reference will be first made to FIG. 3 which shows the configuration used for the production of logs with winding cores. The means used for the production of logs with cores correspond, in this case, to the Italian Patent Application No. FI93A58, whose content is an integral part of the present description. Numerals 101, 103, 107 designate the winding rollers corresponding to rollers 1, 3, 7 of FIG. 1. Numeral 101A indicates the cylindrical surface of roller 101. Indicated by 105 is the nip defined by rollers 101 and 103. The roller 107 is supported by an oscillating arm 109 hinged at 111 to the machine frame. The roller 107 moves gradually upwards about the axis 111 to allow and control the increase of the diameter of the log in the course of formation. The web material N is unreeled from a feeding parent roll (not shown) and guided towards the winding region by a series of driving and guiding rollers 113, 115. Before reaching the winding region defined by rollers 101, 103 and 107, the web material N passes through a perforation group 117, where it is perforated along transverse lines.

Numeral 119 generally indicates a means for feeding the cores A on which the web material N is to be wound for the production of logs. The means 119 includes an endless conveyor 121 provided with a series of supports 123 which pick up the cores one at a time from the inclined end plane 120 of a hopper container or the like (not shown). Each core A passes a gluing unit 125 by means of which a thin layer of glue is applied thereon allowing the leading edge of the web material to be anchored on said cores. The individual cores fed by conveyor 121 are then removed from the conveyor by an insertion means 127 made up of a plate rotating about an axis 128 coincident with the axis of rotation of one of the driving wheels of the endless conveyor 121.

The insertion means 127 moves each core A into a channel 130 defined on one side by the cylindrical surface of the roller 101 and at the other side by a series of shaped plates laminae 132. Each core A is inserted into the channel 130 at the end of the winding of a log, and the free edge of the web material, obtained by a tearing of said material in a manner to be described below, is anchored by the glue on the core as the core is inserted within the channel. The core begins the winding by rolling along the lower fixed curved surface defined by the plates 132, until it reaches the nip 105. Here, the core comes into contact with the roller 103 which rotates at a peripheral speed which is (constantly or temporarily) less than that of roller 101, thereby causing the transit of the core A and the log in the course of formation into the winding space defined by the three rollers 101, 103, 107.

The tearing of the web material N is caused by a series of pressers 134 which, by rotating about their own axis 136, pass between the laminae 132 and pinch the web material between their own surface and the surface of roller 101. The pressers 134 rotate intermittently, and the peripheral speed of the surface thereof which presses against the roller 101 is less than the peripheral speed of the latter. The difference in speed causes the web material N to tear according to the description specified in the Italian Patent Application No. FI93A58.

In order to produce coreless logs by means of the machine of FIGS. 3 and 4, provision is made for moving the upper part of conveyor 121, the gluing group 125, the insertion means 127, and the assembly formed by the axle supporting pressers 134 and by plates 132 away from the winding region. Such moving away is accomplished by a translation along roller guide means 140. At the same time, a group 133 (corresponding substantially to group 33) which is supported by a shaft 137 coincident, in this case, with the axis of rotation of roller 103, is brought near winder roller 101. Numeral 141 indicates a surface corresponding to the surface 61 of FIGS. 1 and 2. Indicated by 143, 145, 146, 147, 148 and 149 are elements corresponding to those indicated by 43, 45, 46, 47, 48 and 49 of FIGS. 1 and 2. The arm 151 carrying the tappet 149 is connected to a cylinder-piston actuator 153 which has the same functions as the system 53, 55 of FIGS. 1 and 2. 154 denotes an adjustable abutment against which the respective arm 151 rests when in working condition.

The system for moving the rollers 101 and 103 close to one another has been omitted in FIGS. 3 and 4, said system being similar to the one shown in FIGS. 1 and 2.

It will be appreciated that the configuration of the rewinder for the production of logs provided with winding cores may be different from that illustrated in the two embodiments, and in practice may be chosen from any of the configurations currently known and used in the machines able to produce exclusively logs with winding cores.

Figure 5:
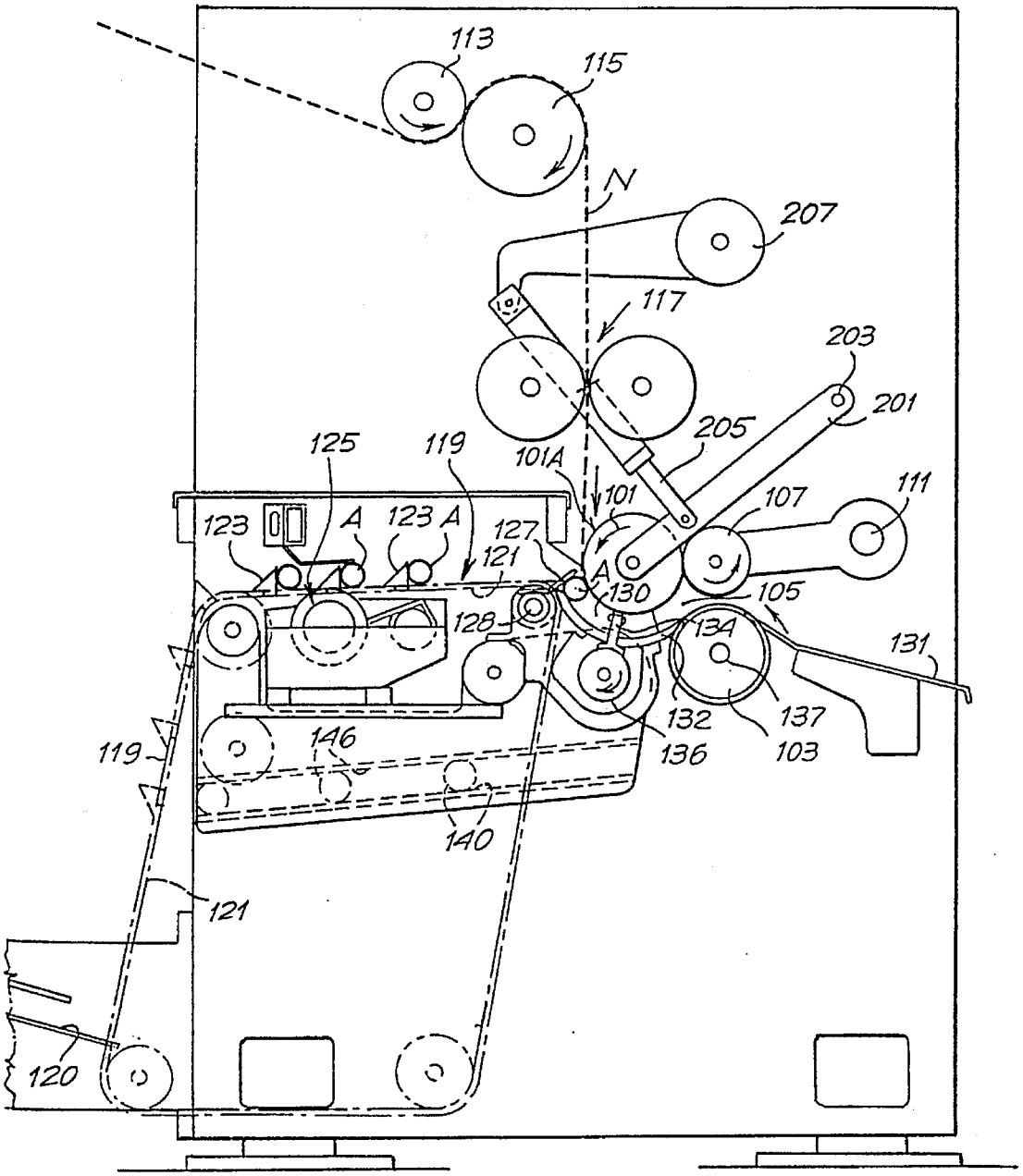
FIG. 5 shows a third embodiment of the rewinder.

FIG. 5 shows an embodiment in which the winding without cores is carried out through the direct cooperation of the winder rollers 101 and 103. Parts corresponding to the embodiment of FIGS. 3 and 4 are indicated by the same numeral reference. Numeral 201 indicates an arm supporting the roller 101, said arm being pivoted at 203. Numeral 205 indicates a resilient connecting rod in the form of a cylinder-piston system and connected to an actuator 207. The system 205, 207 moves the roller 101 about the pivot 203. By means of a suitably longer approaching stroke, the roller 101 is brought close to roller 103 to carry out the winding without cores. In such close relationship, the core conveying group is moved away as shown in the embodiment of FIG. 4. The coreless winding takes place, in this case, with the same procedures as described in corresponding U.S. patent application Ser. No. 090,519, the content of which is incorporated by reference in the present description. The surfaces of rollers 101 and 103 move cyclically close to each other to pinch the web material between them and thus cause said web material to tear and roll up upon itself after tearing.

It is understood that the drawing shows an exemplification given only as a practical demonstration of the invention, as this may vary in the forms and dispositions without, nevertheless, coming out from the scope of the idea on which said invention is based. The possible presence of reference numbers in the appended claims has the purpose of facilitating the reading of the claims, reference being made to the description and the drawing, and does not limit the scope of the protection represented by the claims.

We claim:

1. An automatic surface rewinder for winding web material (N) in logs or rolls (R), including: a first winder roller (1; 101); a second winder roller (3; 103) which defines with the first winder roller a nip (5; 105) through which the web material (N) is fed; feeding means (19, 21; 119, 121) to feed cores (A) on which the web material is to be wound for the formation of rolls or logs; and insertion means (27; 127) for inserting the cores into said nip characterized in that:

the core feeding means (19, 21; 119, 121) and the core insertion means (27; 127) being movable to an inoperative position;

and coreless winding means (33; 133) are included selectively to start the winding of coreless logs of web material, said winding means being operable alternately when the core feeding means and the core insertion means are in an inoperative position.

2. A rewinder according to claim 1 characterized in that the distance between said first and second winding rollers (1, 3; 101, 103) is adjustable and that, when the core insertion means (27; 127) is disposed in the inoperative position, the first and second winding rollers are disposed close to one another to reduce the dimension of said nip (5; 105).

3. A rewinder according to claim 1 characterized in that it includes actuator means (207) which, when the core insertion means (127) is in the inoperative position, cyclically move said two winding rollers (101, 103) relative to each other to press them one against the other at the beginning of every winding operation for the formation of a new log, thereby causing the web material to tear and a free edge thereof to curl up on itself.

4. A rewinder according to claim 2 characterized in that it includes actuator means (207) which, when the core insertion means (127) is in the inoperative position cyclically move said two winding rollers (101, 103) relative to each other to press them one against the other at the beginning of every winding operation for the formation of a new log, thereby causing the web material to tear and a free edge thereof to curl up on itself.

5. A rewinder according to claim 1 characterized in that it includes: a rolling surface (41; 141) which defines a channel along with a movable surface (1A; 101A), on which rolling surface the web material is carried and within which channel the winding of a coreless log begins; and means (43–49; 143–149) which cause the rolling surface (41; 141) and the movable surface cyclically to cooperate with one another to begin the winding of a coreless log (R), said rolling surface (41; 141) being movable between an operative and an inoperative position.

6. A rewinder according to claim 2 characterized in that it includes: a rolling surface (41; 141) which defines a channel along with a movable surface (1A; 101A), on which rolling surface the web material is carried and within which channel the winding of a coreless log begins; and means (43–49; 143–149) which cause the rolling surface (41; 141) and the movable surface cyclically to cooperate with one another to begin the winding of a coreless log (R), said rolling surface (41; 141) being movable between an operative and an inoperative position.

7. A rewinder according to claim 1 characterized in that the core insertion means (27) is pivoted to the frame of the rewinding machine for oscillation about an axis, whereby to be moved to the inoperative position.

8. A rewinder according to claim 2 characterized in that the core insertion means (27) is pivoted to the frame of the rewinding machine for oscillation about an axis, whereby to be moved to the inoperative position.

9. A rewinder according to claim 3 characterized in that the core insertion means (27) is pivoted to the frame of the rewinding machine for oscillation about an axis, whereby to be moved to the inoperative position.

10. A rewinder according to claim 4 characterized in that the core insertion means (27) is pivoted to the frame of the rewinding machine for oscillation about an axis, whereby to be moved to the inoperative position.

11. A rewinder according to claim 1 characterized in that the core feeding and insertion means (19; 119) are movable by translation with respect to the winding rollers (1, 3, 101, 103).

12. A rewinder according to claim 2 characterized in that the core feeding and insertion means (19; 119) are movable by translation with respect to the winding rollers (1, 3, 101, 103).

13. A rewinder according to claim 3 characterized in that the core feeding and insertion means (19; 119) are movable by translation with respect to the winding rollers (1, 3, 101, 103).

14. A rewinder according to claim 4 characterized in that the core feeding and insertion means (19; 119) are movable by translation with respect to the winding rollers (1, 3, 101, 103).

15. A rewinder according to claim 5 characterized in that said rolling surface (41; 141) is carried by a unit (33; 133) which oscillates about an axis (37; 137) parallel to the axis of the first winder roller (1; 101), said unit being able to take up an inoperative position by oscillating about said axis.

16. A rewinder according to claim 6 characterized in that said rolling surface (41; 141) is carried by a unit (33; 133) which oscillates about an axis (37; 137) parallel to the axis of the first winder roller (1; 101), said unit being able to take up an inoperative position by oscillating about said axis.

* * * * *